United States Patent [19]

Takazawa

[11] 3,980,122

[45] Sept. 14, 1976

[54] CURTAIN TURNING DEVICE

[76] Inventor: Ietsugu Takazawa, Bancho-chidorigabuchi Habitation 901, 3 Sanban-cho,, Chiyoda, Tokyo, Japan

[22] Filed: Dec. 6, 1974

[21] Appl. No.: 530,412

[30] Foreign Application Priority Data

May 13, 1974 Japan ..... 49-54162

[52] U.S. Cl. ..... 160/85; 160/120

[51] Int. Cl.[2] ..... A47H 1/00; E06B 9/08

[58] Field of Search ..... 160/85, 120, 121, 122, 160/241

[56] References Cited

UNITED STATES PATENTS

| | | | |
|---|---|---|---|
| 687,870 | 12/1901 | Watkinson | 160/85 |
| 875,129 | 12/1907 | Stephenson | 160/85 |
| 1,708,377 | 4/1929 | Cornell | 160/120 |
| 2,126,328 | 8/1938 | Higby | 160/120 |
| 2,609,042 | 9/1952 | Chamberlain | 160/122 |
| 3,128,688 | 4/1964 | Coda | 160/85 |
| 3,789,904 | 2/1974 | Takazawa | 160/120 |
| 3,822,733 | 7/1974 | Lindelow | 160/120 |

*Primary Examiner*—Paul R. Gilliam
*Assistant Examiner*—Victor N. Sakran
*Attorney, Agent, or Firm*—Holman & Stern

[57] ABSTRACT

A curtain turning device wherein a fitting frame is fitted at one end with a supporting case and at the other end with a supporting case containing a rotating device operated with a strip, a winding shaft is connected and borne in the upper parts of the above mentioned supporting cases, holes are made respectively in the lower parts of the supporting cases, a fitting rod formed of a hollow part made hollow inside and a shaft part is rotatably inserted and fitted in said holes through lid plates free to be fitted to and removed from said fitting rod and a curtain payed out of the winding shaft is fitted to the shaft part of the fitting rod through suspending rod members.

2 Claims, 4 Drawing Figures

CURTAIN TURNING DEVICE

This invention relates to improvements in a device for automatically turning a curtain to be wound up.

There is already a curtain of this kind which is fitted at one end to a winding shaft and at the other end to a fixed shaft provided adjacently to the winding shaft, is folded at the suspended lower end so as to be double and is kept suspended by arranging a shaft rod within the folded lower end. However, in such case, only one surface of the doubled surfaces will appear outside and whenever the surface is stained or is desired to be of different patterns, the curtain itself will have to be replaced much to the trouble. The present invention is an improvement to eliminate such trouble as is mentioned above and to stabilize the turning operation of a curtain.

An embodiment of the present invention shall be explained with reference to the drawings in which.

Figure 1:
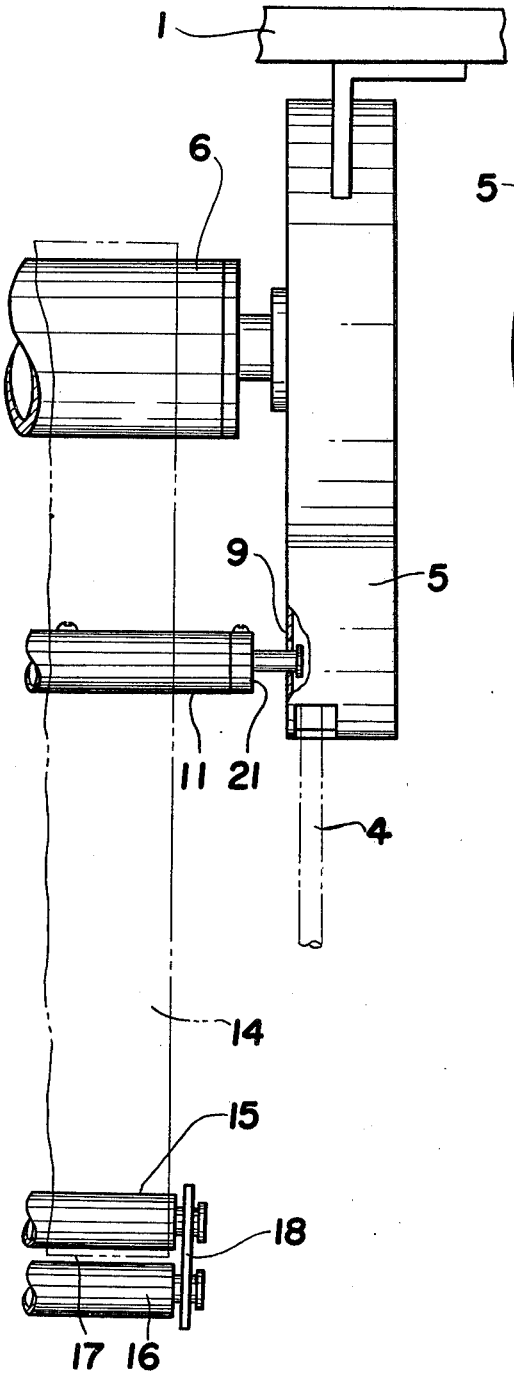
FIG. 1 is a partly cross sectioned elevation of a curtain as fitted.

A fitting frame (1) is fitted at one end with a supporting case (3) provided with a bearing part (2) and at the other end with a supporting case (5) containing a rotating device not illustrated but made to rotate normally and reversely and stop by the operation of a string (4) as opposed to said supporting case (3). A winding shaft (6) is rotatably borne at one end (7) with the bearing part (2) of the above mentioned supporting case (3) and is connected and borne at the other end (8) with the rotating device in the other supporting case (5) so that the winding shaft borne at both ends with the supporting cases (3) and (5) may be rotated normally and reversely and kept stopped. Holes (9) and (13) are made in the lower parts of the supporting cases (3) and (5), respectively, and a fitting rod (11) formed of a hollow part (10) made hollow inside and a shaft part (20) is rotatably inserted in said holes (9) and (13) so as to be fitted directly to the supporting cases (3) and (5) through lid plates (21) which are free to be fitted to and removed from said fitting rod (11). A curtain (14) is wound and fixed at one end to the shaft part (20) of the above mentioned fitting rod (11). Two upper and lower shaft rods (15) and (16) of a length larger than the width of the curtain are formed to be parallel with each other with a fixed clearance (17) between them and are rotatably connected at both ends with each other through connecting plates (18) forming suspending rod members (19). That is to say, the curtain (14) is fitted at one end to the winding shaft (6) so as to be properly wound up, is inserted at the other end through the clearance (17) between the upper and lower shaft rods (15) and (16) of the suspending rod members (19) and is fitted at the other end to the fitting rod (11). Said fitting rod (11) and supporting cases (3) and (5) are fixed so that the curtain may be wound up without any trouble.

Figure 2:
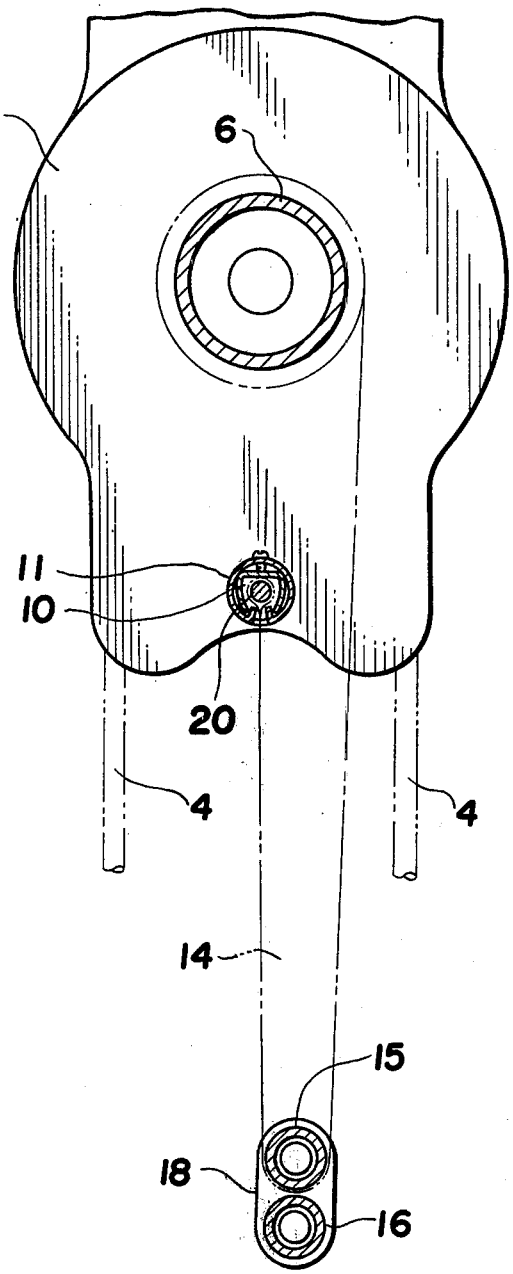
FIG. 2 is a vertically cross sectioned side view of the same.
Figure 3:
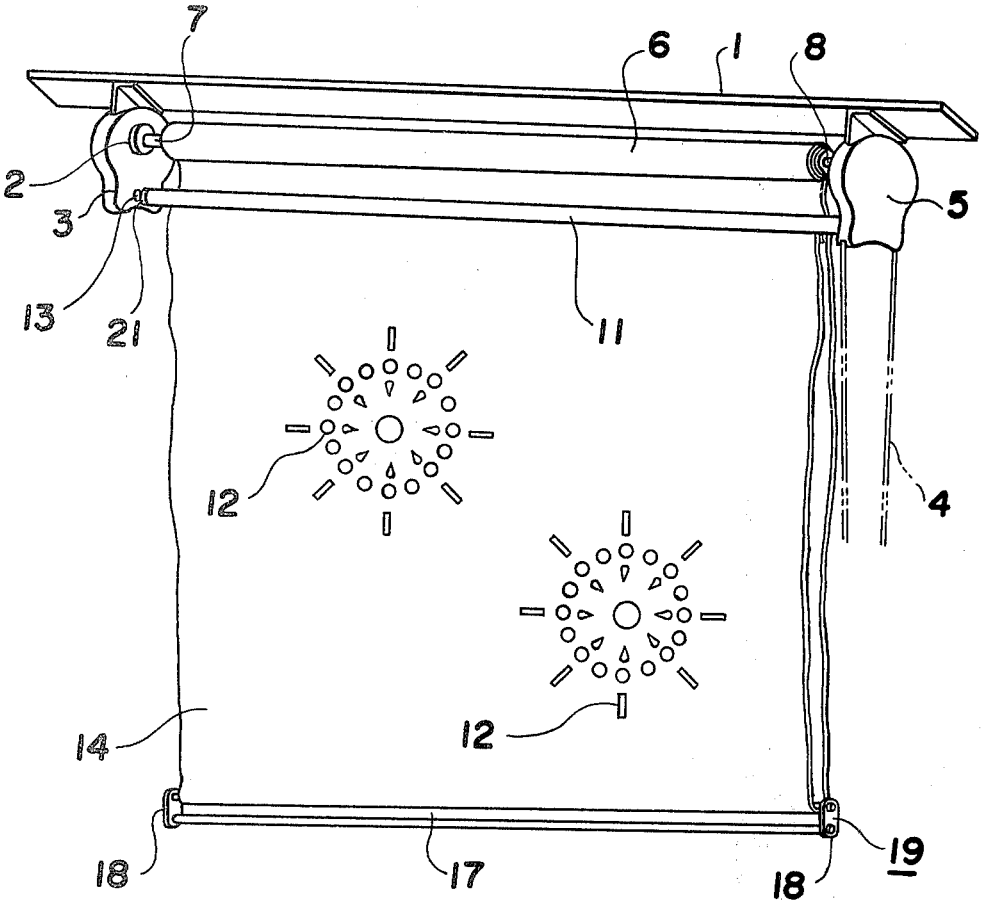
FIG. 3 is an elevation of a curtain suspending device.
Figure 4:
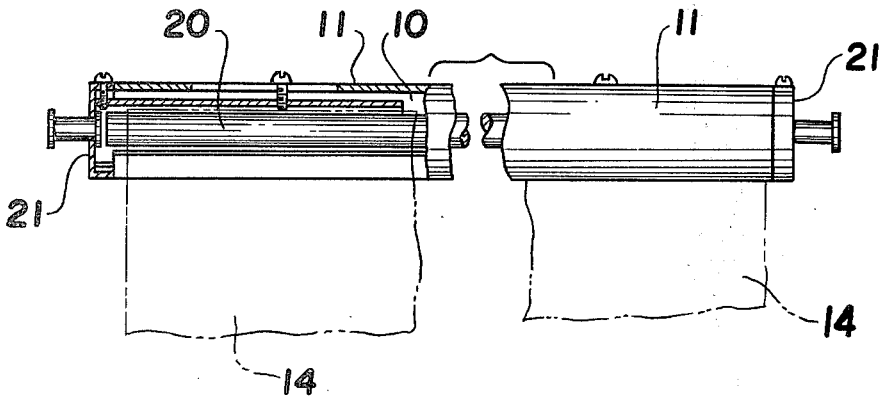
FIG. 4 is a partly cross sectioned elevation of a fitting rod.

The operation of the present invention shall be explained in the following. When the string (4) is freely operated to pay out the curtain (14) from its configuration wound on shaft 20 of fitting rod 11 as shown in FIG. 2, the curtain (14) provided with proper cut patterns (12) as shown in FIG. 3 will be kept suspended in the form of a double curtain with a first colored surface outside and the other (second) surface of a different color inside and will be able to be wound up onto winding shaft (6) without slipping so as to warm and decorate a window part or inlet or outlet of a room.

In short, in the present invention, a fitting frame (1) is fitted at one end with a supporting case (3) and at the other end with a supporting case (5) containing a rotating device operated with a string (4). A winding shaft (6) is connected and borne in the upper parts of the above mentioned supporting cases (3) and (5). Holes (9) and (13) are made in the lower parts of the supporting cases (3) and (5), respectively, and a fitting rod (11) formed of a hollow part (10) made hollow inside and a shaft part (20) is rotatably inserted and fitted in said holes (9) and (13) through lid plates (21) free to be fitted to and removed from said fitting rod. A curtain (14) attached to the winding shaft (6) is fitted to the shaft part (20) of the fitting rod (11) through suspending rod members (19). Therefore it is not necessary to replace and fit the curtain itself as in the conventional case. Further, as the fitting rod (11) is rotatably fitted directly to the lower parts of the supporting cases (3) and (5), the fitting rod (11) will be prevented from moving as inclined and therefore the curtain will not be likely to slip and will operate without being twisted. Therefore the curtain (14) can be turned smoothly, quickly and easily such that the second colored surface becomes the outside surface. Further, the curtain (14) is fixed at one end to the shaft part (20) of the fitting rod (11) so that the stain of the curtain (14) may be reduced. Thus the practical advantages of the present invention are large.

What is claimed is:

1. In a curtain turning device including an elongated fitting frame having supporting cases at opposite ends thereof, a winding shaft substantially parallel to said fitting frame and journaled for rotation in said cases, rotating means in one of said cases associated with said winding shaft for rotating said shaft, a fitting rod substantially parallel to said winding shaft and supported from said cases below and spaced from said winding shaft, said fitting rod comprising an elongated tubular portion having removable closure means at the open ends thereof and a substantially concentric shaft portion in said tubular portion, said shaft portion passing through said closure means and rotatably journaled in said cases, and a curtain having first and second opposite surfaces folded over on itself fitted between said shaft portion of said fitting rod and said winding shaft with suspending rod means in said fold to tension said curtain into a generally U-shaped configuration whereby said first surface of the curtain constitutes the outside of said U-shape and said second surface of the curtain constitutes the inside of said U-shape, the improvement wherein said suspending rod means comprises two relatively rotatable, generally parallel elongated rod-like members disposed in a vertical plane and having a fixed spacing therebetween for passing said curtain therethrough, each of said rod-like members having a length greater than the width of said curtain, whereby one of said rod-like members is disposed in said fold when said first curtain surface constitutes the outside surface of said U-shape and the other of said rod-like members is disposed in said fold when said curtain is turned such that said second curtain surface constitutes the outside surface of said U-shape.

2. A curtain turning device, as claimed in claim 1, wherein one of said rod-like members is disposed vertically above the other of said rod-like members and including a support member adjacent each pair of corresponding ends of said rod-like members for rotatably mounting said pairs of corresponding ends therein.

* * * * *